US010292502B2

(12) United States Patent
Hamid

(10) Patent No.: US 10,292,502 B2
(45) Date of Patent: May 21, 2019

(54) FOLDABLE CHAIR

(71) Applicant: Omar Emad Hamid, Atlanta, GA (US)

(72) Inventor: Omar Emad Hamid, Atlanta, GA (US)

( * ) Notice: Subject to any disclaimer, the term of this patent is extended or adjusted under 35 U.S.C. 154(b) by 237 days.

(21) Appl. No.: 15/253,831

(22) Filed: Aug. 31, 2016

(65) Prior Publication Data

US 2018/0055231 A1 Mar. 1, 2018

(51) Int. Cl.

| | |
|---|---|
| ***A47C 7/56*** | (2006.01) |
| ***A47C 1/12*** | (2006.01) |
| ***A47C 4/04*** | (2006.01) |
| ***A47C 9/06*** | (2006.01) |
| ***A61G 5/14*** | (2006.01) |

(52) U.S. Cl.

CPC ..... *A47C 7/566* (2013.01); *A47C 1/12* (2013.01); *A47C 4/04* (2013.01); *A47C 7/563* (2013.01); *A47C 9/06* (2013.01); *A61G 5/14* (2013.01)

(58) Field of Classification Search

CPC .. A47C 3/22; A47C 3/40; A47C 7/563; A47C 7/566; A47C 16/04; A61G 5/14

See application file for complete search history.

(56) References Cited

U.S. PATENT DOCUMENTS 1,288,216 A * 12/1918 Sayles ..... A47C 7/445 248/598
2,442,303 A * 5/1948 Mayfield ..... A61G 5/14 297/320
3,539,220 A * 11/1970 Aguilar ..... A47C 3/22 297/320
4,249,774 A * 2/1981 Andreasson ..... A61G 5/14 297/311
4,632,455 A * 12/1986 Schiller ..... A61G 5/14 297/183.9
5,094,508 A * 3/1992 Bathrick ..... A61G 5/14 297/320
5,219,204 A * 6/1993 Bathrick ..... A47C 1/0355 297/321
5,253,922 A * 10/1993 Corlett ..... A47C 3/20 297/195.1
5,390,979 A * 2/1995 Corlett ..... A47C 9/005 297/328
5,803,545 A * 9/1998 Guguin ..... A61G 5/14 297/316
5,984,338 A * 11/1999 Meyer ..... A61G 5/14 280/304.1
5,984,411 A * 11/1999 Galumbeck ..... A61G 5/14 297/330

(Continued)

*Primary Examiner* — David R Dunn
*Assistant Examiner* — Tania Abraham
(74) *Attorney, Agent, or Firm* — Richard C. Litman

(57) ABSTRACT

A foldable chair includes a seat panel having a first end portion and a second end portion, a pivotable support having a first end portion and a second end portion, the first end portion of the pivotable support pivotally connected to the first end portion of the seat panel, and a variable resistance support assembly pivotally coupled to the second end portion of the seat panel for selectively raising and lowering the seat panel. The variable resistance support assembly can include a housing, with a first spring and a second spring stored therein. The first spring can have a first pressure load and the second spring can have a second pressure load that is less than the first pressure load.

14 Claims, 9 Drawing Sheets

(56) References Cited

U.S. PATENT DOCUMENTS

| | | | | |
|---|---|---|---|---|
| 6,752,459 | B2 * | 6/2004 | Deisig | A47C 3/20 297/284.11 |
| 7,000,988 | B2 * | 2/2006 | Bressler | A61G 5/14 297/313 |
| 7,540,565 | B2 * | 6/2009 | Lipford | A61G 5/14 297/284.3 |
| 7,669,863 | B2 * | 3/2010 | Steiner | A61G 5/14 280/250.1 |
| 8,113,587 | B1 * | 2/2012 | Zarinfar | A61G 5/08 297/337 |
| 8,272,692 | B1 * | 9/2012 | Epperson | A47C 1/03272 297/296 |
| 2012/0126601 | A1 * | 5/2012 | Smith | A61G 5/14 297/339 |
| 2013/0069407 | A1 * | 3/2013 | Park | A61G 5/14 297/313 |
| 2014/0103688 | A1 * | 4/2014 | Wilson | A47C 1/03211 297/337 |
| 2014/0197669 | A1 | 7/2014 | Daghistani | |

* cited by examiner

FOLDABLE CHAIR

BACKGROUND OF THE INVENTION

1. Field of the Invention

The present invention relates to seats, and particularly to a foldable chair that occupies a relatively small amount of space and provides a more ergonomic folding motion following the natural standing and sitting motions of a user for comfortable, selective deployment and support.

2. Description of the Related Art

Foldable chairs can include moveable individual chairs, or a stationary group of connected chairs. Foldable chairs provide flexibility in utilizing available space. For example, when an event requires seating, the foldable chair may be extended into the available space. When an event requires the space for purposes other than seating, the foldable chairs may be stowed away to provide more space for other purposes.

In mosques, for example, foldable chairs are often brought into a prayer area when needed for disabled, elderly, or other individuals for whom it is difficult to assume the various physical positions required during the muslim prayer. These conventional foldable chairs, however, are generally bulky, unstable, and/or occupy more space than is needed to accommodate the user. Further, these conventional foldable chairs do not provide any dynamic support or assistance to the user during the process of sitting and standing.

In light of the above, a foldable chair that is compact and supports the user attempting to sit on or rise from the chair, is desirable.

SUMMARY OF THE INVENTION

A foldable chair includes a seat panel having a first end portion and a second end portion, a pivotable support having a first end portion and a second end portion, the first end portion of the pivotable support pivotally connected to the first end portion of the seat panel, and a variable resistance support assembly pivotally coupled to the second end portion of the seat panel for selectively raising and lowering the second end portion of the seat panel. The foldable chair can include a back rest affixed to the first end of the variable resistance assembly and a base affixed to the second end of the variable resistance assembly. The variable resistance support assembly can include a housing, with a first spring and a second spring stored therein. The first spring can have a first pressure load and the second spring can have a second pressure load that is less than the first pressure load.

A foldable chair system includes a plurality of the foldable chairs connected to a common support or stand.

The foldable chair and/or foldable chair system can be useful in auditoriums, stadiums, theaters, arenas, conference centers, airports, places of worship (e.g., a church or mosque), education facilities, classrooms, performance halls and the like.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
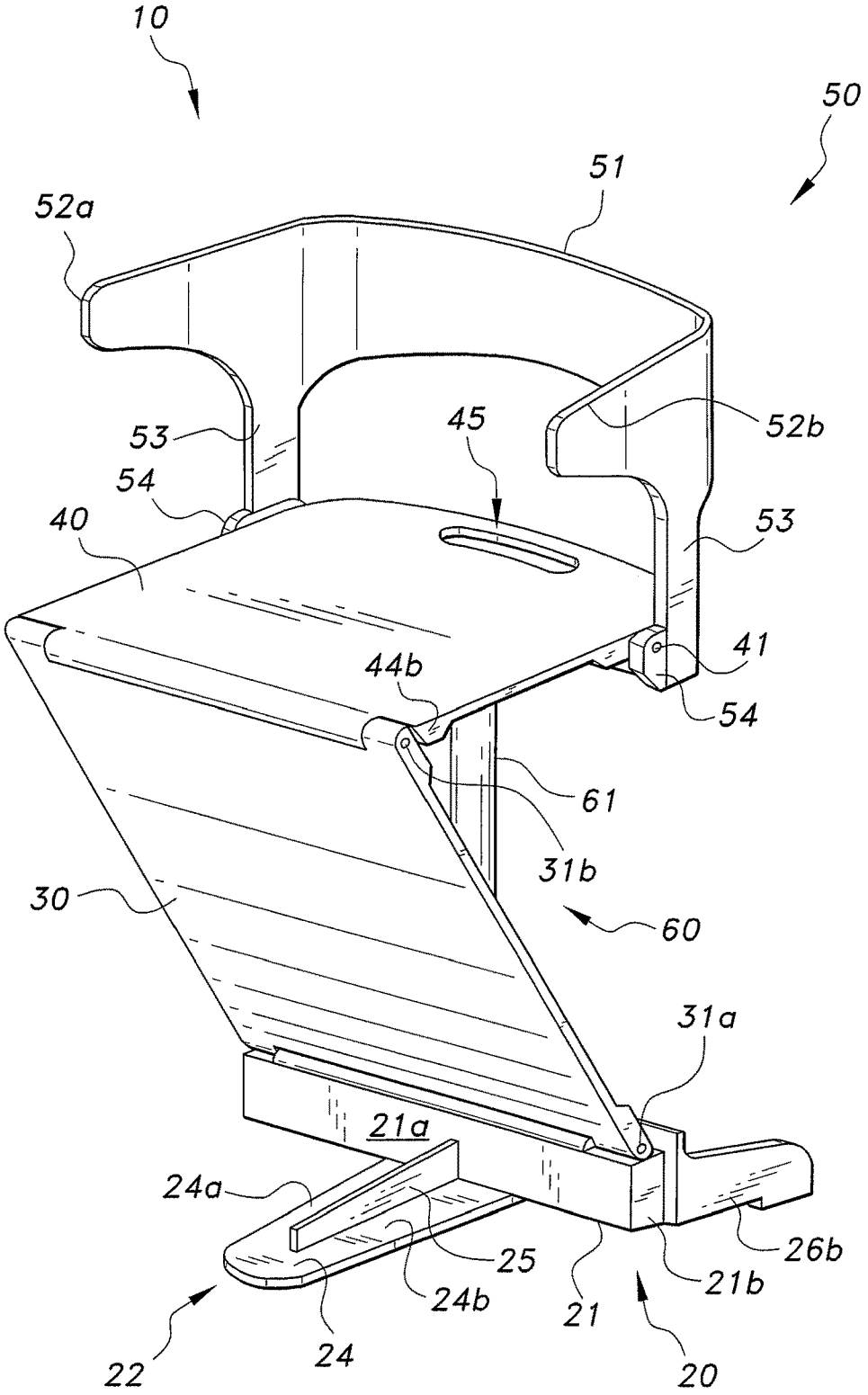
FIG. 1 is a front perspective view of a foldable chair according to the present invention.

A foldable chair, a first embodiment of which is generally referred to by the reference number 10 in FIGS. 1-4, can include a seat panel 40 having a first end portion and a second end portion, a pivotable support 30 having a first end portion and a second end portion, the first end portion of the pivotable support 30 pivotally connected to the first end portion of the seat panel 40, and a variable resistance support assembly 60, the variable resistance support assembly 60 coupled to the second end portion of the seat panel 40 for selectively raising and lowering the second end portion of the seat panel 40. The foldable chair can include a back rest 50 affixed to the variable resistance support assembly 60 and a base 20 affixed to both the variable resistance support assembly 60 and the second end portion of the pivotable support 30.

The variable resistance support assembly 60 is compressible to allow the second end portion of the seat panel 40 to be lowered from one or more raised positons in response to a force exerted by the user on the seat panel 40, e.g., during the sitting motion of the user. The variable resistance support assembly 60 is configured to provide at least two levels of resistance as the user sits on the seat panel 40. The variable resistance can include a first resistance and a second resistance. The first resistance can be lesser than the second resistance. The second pressure load or amount of force can be greater than the first pressure load or amount of force. The variable resistance support assembly 60 can include one or more springs, as is known in the art, to provide this type of variable resistance. Thus, for example, the second end portion of the seat panel can be lowered to a first level in response to a first pressure load or amount of force exerted by the user and to a second level in response to a second pressure load or amount force exerted by the user. Accordingly, the degree of resistance provided as the user first lowers the seat panel by starting to sit thereon can be less than that provided as the seat panel 40 nears its horizontal, seating position.

Figure 3:
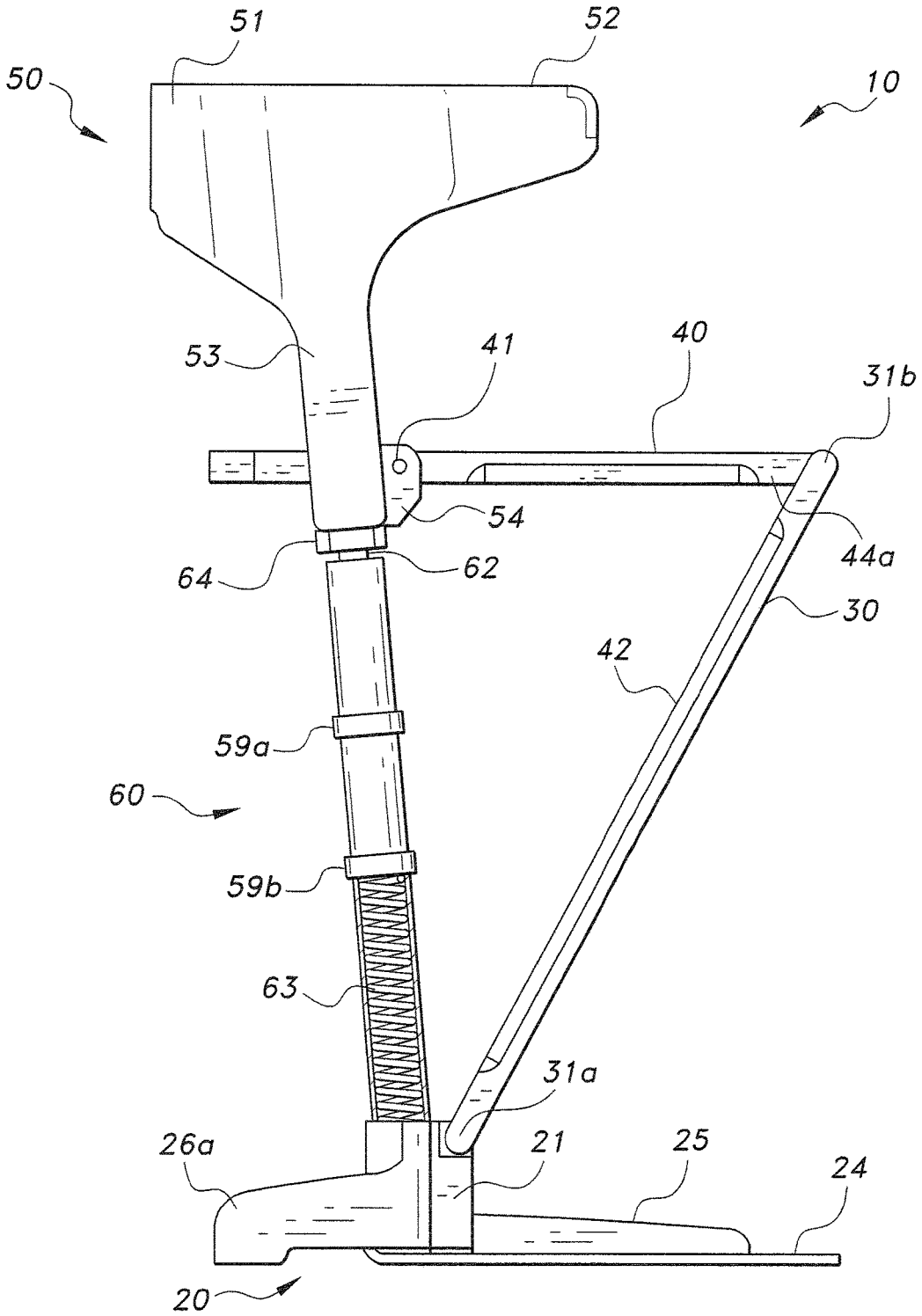
FIG. 3 is a side view of the foldable chair shown in FIG. 1 with the housing removed for clarity.

In an embodiment, the variable resistance support assembly 60 can include a telescoping support assembly. The telescoping support assembly can include a housing 61, with a first spring 62 and a second spring 63 stored therein (FIG. 3). A seat panel support 57 can be coupled to or in communication with the first spring 62 to provide additional support to the seat panel 40 disposed thereon. The seat panel support 57 can define a top end of the telescoping support assembly and extend over the housing 61, e.g., normal to the housing 61. The seat panel support 57 can include one or more mounting tabs 54 for pivotally mounting to the seat panel 40. The first spring 62 can have a first resistance and the second spring 63 can have a second resistance that is less than the first resistance. A portion of the first spring 62 is configured to selectively extend into or out of the housing 61 to move the second end portion of the seat panel 40 between a lowered, seating position and one or more raised positions that are above the seating position. The telescoping assembly 60 is configured to maintain the seat panel 40 of the foldable chair 10 in the raised position until the user exerts pressure on the seat panel 40 to lower the seat panel 40 for seating. In other words, the raised position is the default position of the foldable chair 10. In the raised position, the upper surface of the seat panel 40 or the surface of the seat panel 40 upon which a user sits is exposed or faces the user. Further, the seat panel 40 can be at least partly inclined with respect to the variable resistance assembly 60 in the raised position. As such, the user can lower the seat panel 40 simply by sitting on or pressing against the exposed surface of the seat panel 40, thereby obviating a need for the user to use his/her hands to lower the seat.

In a preferred embodiment, the first spring 62 is a gas spring including a valve or other actuator and a piston. The piston selectively extends and retracts with respect to the housing, as is generally known. The second spring 63 can be a compression spring that is connected to the first spring 62, for example. The compression spring can have a lighter pressure load than the gas spring. As such, when a user begins to sit on the seat panel 40, the initial resistance (provided by the compression spring) is low to allow the seat panel 40 to be easily lowered initially and the subsequent resistance (provided by the gas spring) is greater to provide some damping as the seat panel 40 stops at the seating position. Further, when a user begins to rise from the seat panel 40, the resulting lowered pressure on the gas spring can cause the piston of the gas spring and the attached seat panel to move upward. This upward movement of the piston can facilitate lifting the user and/or assisting the user to stand.

The base 20 can include a base beam 21 spanning a substantial width of the foldable chair 10. In an exemplary embodiment, the base beam 21 can have a length of about 400 mm. The base beam 21 includes a long flat side or facet 21*a* facing the front of the foldable chair 10, two spaced side facets 21*b* defining the sides, and rear facets 21*c*, 21*d* facing the rear. A foot rest 22 can optionally extend in front of the base beam 21. The foot rest 22 is preferably detachable and includes an elongate L-shaped bracket having a first portion 23 mounted to the rear facet 21*c* with suitable fasteners 22*a* and a second portion 24 secured to the bottom of the base beam 21 with similar fasteners 22*a*. The first portion 23 may be shorter than the second portion 24. The second portion 24 can include a central rib 25 extending upwardly along the length of the second portion 24 to divide the second portion 24 into right and left web sections 24*a*, 24*b*.

Figure 4:
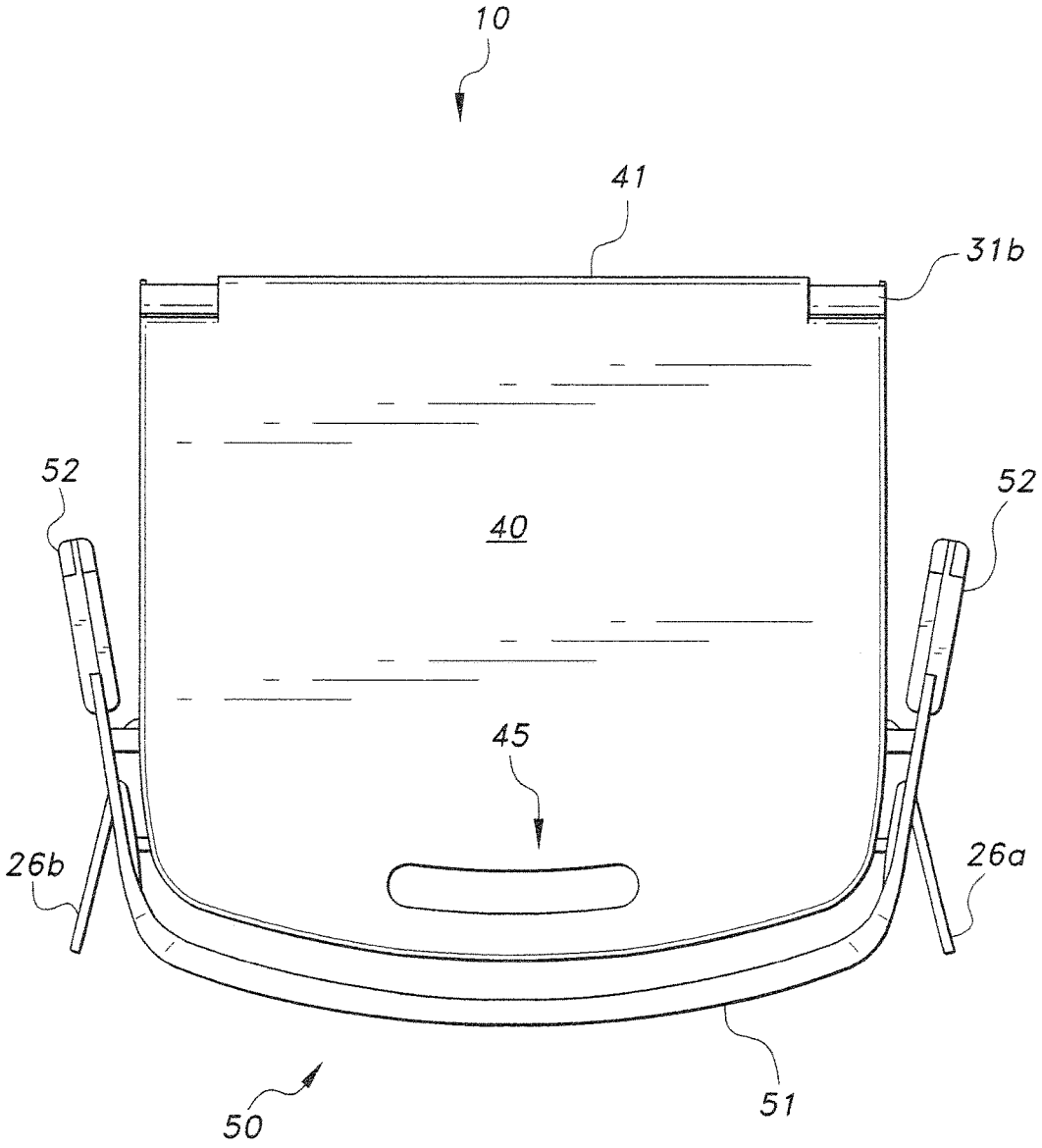
FIG. 4 is top plan view of the foldable chair shown in FIG. 1.

The base 20 includes a pair of spaced brace legs 26*a*, 26*b* which extend to the rear of the base beam 21. The brace legs 26*a*, 26*b* stabilize the back of the foldable chair 10. As best seen in FIG. 4, the brace legs 26*a*, 26*b* preferably extend at an angle with respect to the corresponding side facet 21*b* so that the brace legs 26*a*, 26*b* flare from the base beam 21. This configuration enables easier and space efficient, back-to-front stacking of multiple foldable chairs 10.

Referring back to FIG. 1, the second end portion of the pivotable support 30 can be pivotally mounted to the base beam 21 by a first hinge or pivot 31*a*. The first end portion of the pivotable support 30 can be mounted to the first end portion of the seat panel 40 by a second hinge or pivot 31*b*. The pivotable support 30 selectively pivots to facilitate raising and lowering of the first end portion of the seat panel 40. It should be recognized that the size of the pivotable support 30, as well as the specific shape, may be varied to accommodate any user and/or desired aesthetic, so long as the pivotable support 30 provides the necessary support and functionality. For example, the pivotable support 30 may be contoured to provide a comfortable support surface for the user's lower leg portions. In such an embodiment, the front side or face of the pivotable support 30 can be smooth and a rear surface thereof can include one or more reinforcing ribs 32, 33. These ribs 32, 33 can provide reinforcement and enhanced sturdiness to the pivotable support 30.

The seat panel 40 can include a rigid or substantially rigid material with the first end portion pivotally mounted to the pivotable support 30, as described previously, and the second or opposite end pivotally mounted to the seat support panel 57 of the variable resistance assembly 60 by a third hinge or pivot 41. The hinged connection of the seat panel 40 to the pivotable support 30 and the variable resistance assembly 60 facilitates folding and unfolding of the seat panel 40, as the seat panel 40 is raised or lowered by the variable resistance assembly 60. The seat panel 40 is suitably dimensioned for most user sizes. In an exemplary embodiment, the seat panel 40 can have a width of about 400 mm. It should be recognized, however, that the size of the seat panel 40, as well as the specific shape, may be varied to accommodate any user and/or desired aesthetic, so long as the seat panel 40 provides the necessary support and functionality. The front side or face of the seat panel 40 is preferably smooth while the back face includes one or more reinforcing ribs 42, 43. These ribs 42, 43 provide reinforcement and enhanced sturdiness to the seat panel 40 for increased strength and durability.

Figure 2:
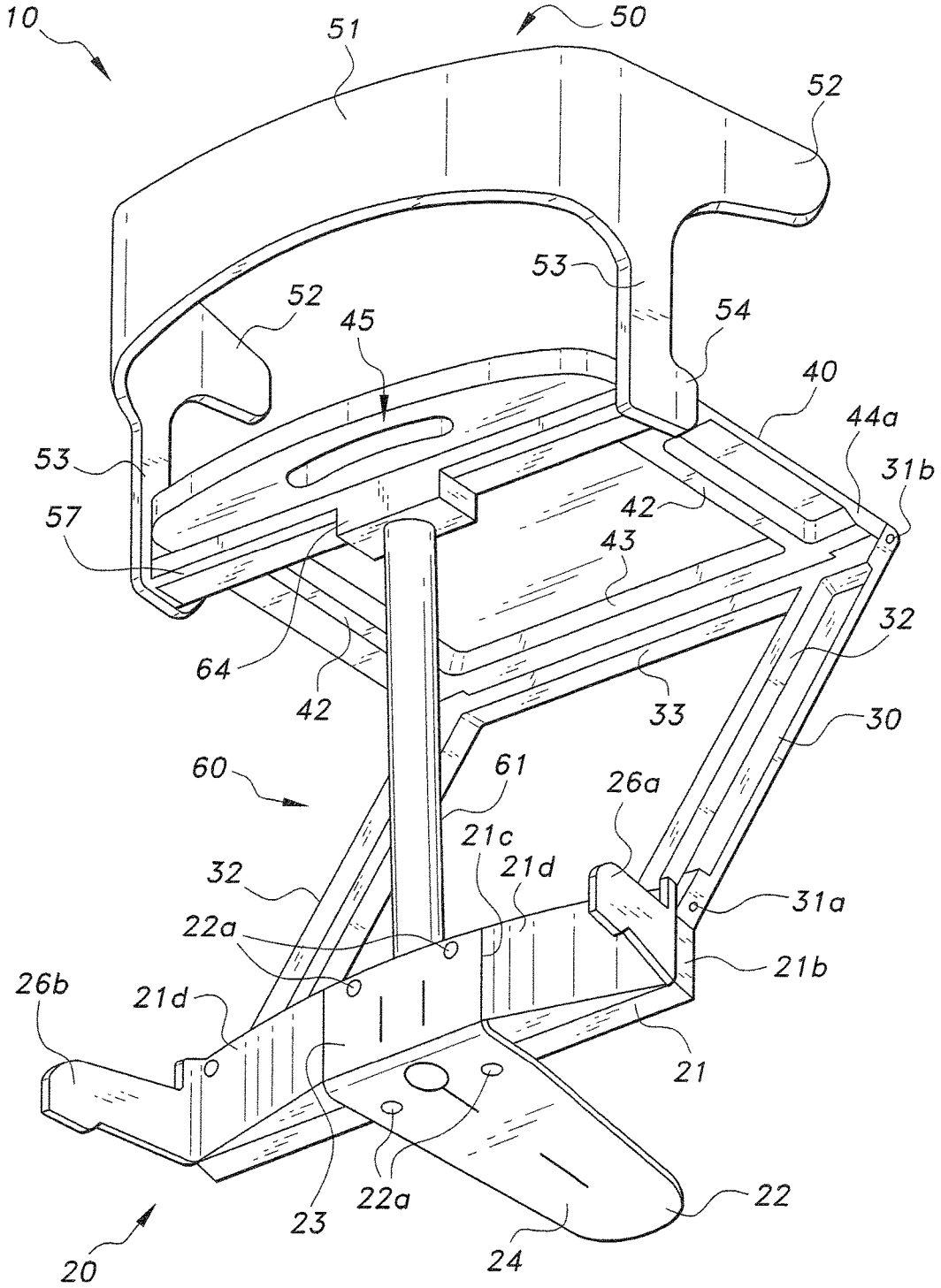
FIG. 2 is a rear perspective view of the foldable chair shown in FIG. 1.

As shown in FIG. 2, the seat panel 40 can include a pair of beveled, corner abutment stops 44*a*, 44*b*. When unfolded, the beveled side of the corner abutment stops 44*a*, 44*b* can abut the top rib 33 of the pivotable support 30 to position and fix the seat panel 40 at the first, generally horizontal position, parallel to the floor or horizontal support surface on which it is positioned. This is a preferred sitting position for most users. The corner abutment stops 44*a*, 44*b* may be separate components or an integral feature of the bottom rib 43.

The foldable chair 10 can be lightweight, compact and portable. The foldable chair 10 can have any suitable dimensions to provide the desired functionality and space saving features. To assist in transport and handling of the foldable chair 10, the second end of the seat panel 40 can be provided with an elongate handle slot 45. The handle slot 45 may be a straight or curved opening through which the user's hand may extend to lift the foldable chair 10 for repositioning, transport, or operation of the foldable chair 10.

The back rest 50 can include an elongate back support panel 51, and a pair of armrests 52*a*, 52*b* extending from opposing ends of the back support panel 51. The back rest 50 can have an opening through which the second end portion of the seat panel 40 may extend when in the first or seating position. Similar to the brace legs 26*a*, 26*b*, the armrests 52 can extend at an angle with respect to the back support panel 51 so that they flare outwardly towards the front of the foldable chair 10, in a direction opposite from the brace legs 26*a*, 26*b*. The opposite angled extensions of the brace legs 26*a*, 26*b* and the armrests 52*a*, 52*b* can best be seen in FIG. 4. In an exemplary embodiment, a distance between the free ends of the armrests can be about 488 mm, and a distance between the free ends of the brace legs 26*a*, 26*b* can be about 471 mm. As with the brace legs 26*a*, 26*b*, the flaring of the armrests 52*a*, 52*b* also assists in back-to-front stacking of the multiple foldable chairs 10 without interference.

A back rest support beam 53 extends between each armrest 52 and the seat panel support 57 of the variable resistance assembly 60. As can be seen from FIGS. 1-3, the back support panel 51, armrests 52, and the back rest support beam 53 can be an integral unit or may be provided as separate components to be coupled by any conventional means, such as fasteners, welds, adhesives, and the like. Though the armrests 52*a*, 52*b* extend from the back support panel 51 at the same height, the relative height between the armrests 52*a*, 52*b* and the back support panel 51 may be varied. For example, the back support panel 51 may be set higher than the armrests 52*a*, 52*b* to provide more support to the upper back of the user, or the armrests 52*a*, 52*b* may be set higher than the back support panel 51 so that the user's forearms rest closer to the height of the shoulders.

The back rest support beams 53 can be attached to opposite ends of the seat panel support 57. The seat panel support 57 can include a raised, mount section 64 for coupling to the first spring 62. The length of the first spring 62 is predetermined or predefined so that the fully retracted position of the first spring 62 defines the first or horizontal orientation of the seat panel 40 in the seating configuration shown in FIGS. 1-3. Other types of telescoping mechanisms such as pneumatic cylinders, hydraulic cylinders, powered cylinders, and the like may also be used.

Though the back rest 50 has been described as being fixed to the seat panel support 57, it is also contemplated that the back support panel 51 may be configured to pivot with respect to the seat panel support 57 so as to facilitate folding of the back support panel 51 onto the seat surface of the seat panel 30. This may be accomplished with suitable pivot connections and abutment stops. This will further increase the compactness of the foldable chair 10.

The variable resistance assembly 60 can be disposed at an angle, e.g., slightly slanted, with respect to the base, as more clearly shown in FIG. 3. This assists in forming a stable, generally Z-shaped profile when viewed from the side, with the base 20, the pivotable support 30, and the seat panel 40. The pivoting movements of the pivotable support 30 and the seat panel 40 occur with respect to the horizontal disposition of the base 20. This lean of the variable resistance assembly 60 also more closely follows the natural contours of the user's lower body when seated. These features, amongst others, enable the foldable chair 10 to support the user throughout the process of standing and sitting, thereby increasing comfort and relieving much of the difficulties and potential pain experienced by those who may be too infirm or debilitated to perform these actions.

When a user rises from a seated position, the seat panel 40 is conveniently unfolded out of the way without any interference from the foldable chair 10. A plurality of foldable chairs 10 may be stacked back-to-front without occupying too much space because they would be nestled with each other.

Another embodiment of a foldable chair 100 is shown in FIGS. 5-7C. Like the foldable chair 10, the foldable chair 100 includes a base 120, a pivotable support 130 pivotally mounted to the base 120 at one end, a seat panel 140 pivotally mounted to the opposite end of the pivotable support 130, and a variable resistance assembly 160 coupled to the base 120 for selective folding and unfolding of the foldable chair 100 between a seat configuration and an extended stand configuration. The variable resistance assembly 160 can include a telescoping assembly as described above with respect to the folding chair 10. The base 120 includes an elongate base beam 121 spanning a substantial width of the foldable chair 100. A foot rest 122 can extend from the base beam 121 towards the front of the foldable chair 100. A pair of spaced brace legs 126*a*, 126*b* extends in a rearward direction from the back of the base beam 121. The brace legs 126*a*, 126*b* stabilize the back of the foldable chair 100. Each brace leg 126*a*, 126*b* is also provided with a caster 127 to assist and ease transport.

The pivotable support 130 is pivotally mounted to the base beam 121 by a first hinge or pivot 131*a*, and pivotally mounted to the seat panel 140 by a second hinge or pivot 131*b*. The pivotable support 130 includes one or more reinforcing ribs 132, 133 on a back surface thereof. The pivotable support 130 may be provided with corner abutment stops 134*a*, 134*b* disposed near the top left and right corners at the back of the pivotable support 130. These corner abutment stops 134*a*, 134*b* support the front end of the seat panel 140 when the seat panel 140 unfolds into the seated configuration and assists in maintaining the horizontal disposition of the seat panel 140.

Figure 5:
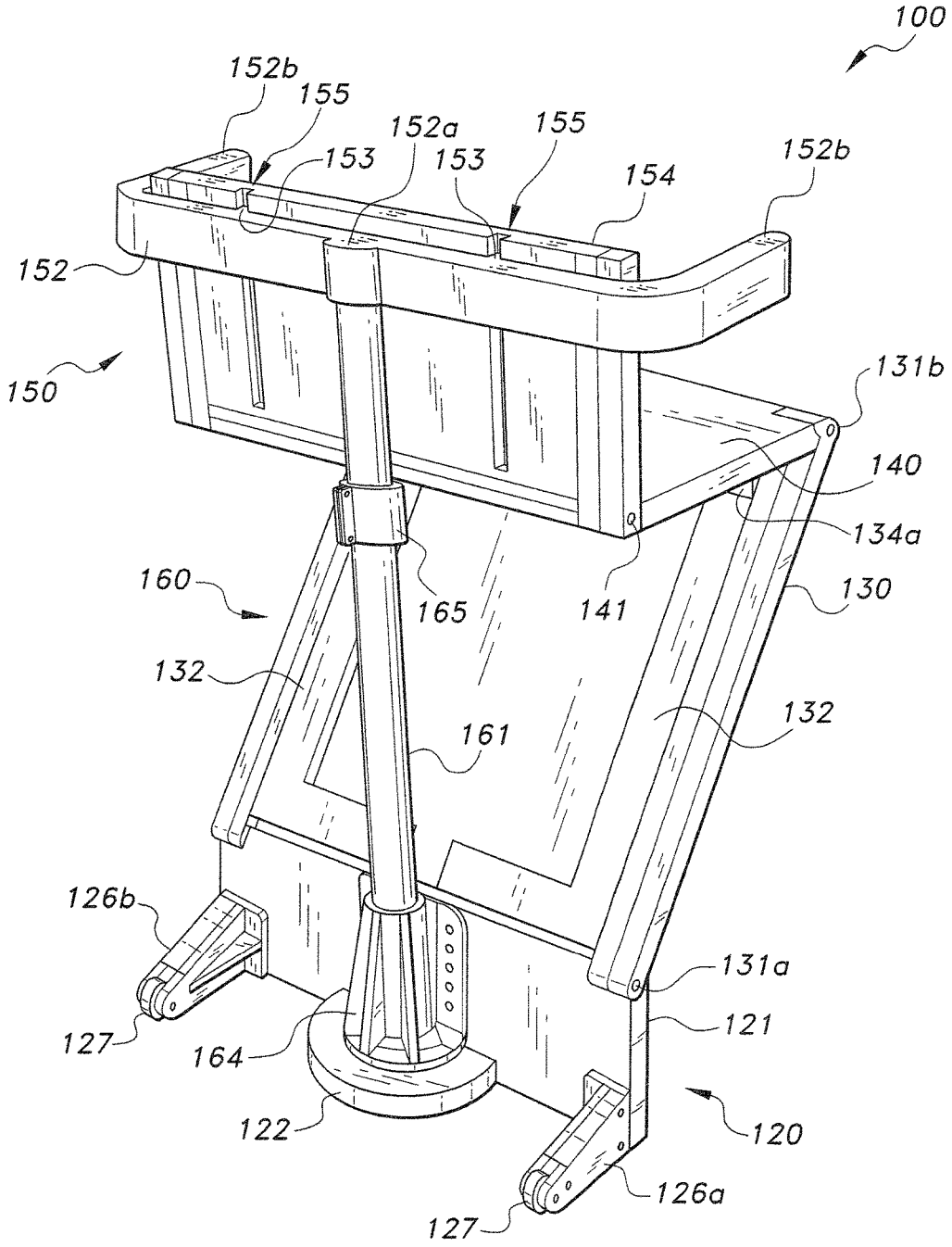
FIG. 5 is a rear perspective view of another embodiment of a foldable chair according to the present invention.

Unlike the foldable chair 10, the seat panel 140 includes one end pivotally mounted to the pivotable support 130 as described above, and an opposite end pivotally mounted to the back rest 150 by a third hinge or pivot 141. The variable resistance assembly 160 can be directly affixed to the back rest 150, as shown in FIG. 5. The back rest 150 includes an elongate, generally U-shaped back rest support beam 152 with a mount 152*a* formed thereon, and a pair of spaced armrests 152*b* at opposing ends of the support beam 152. The mount 152*a* is fixed to the variable resistance assembly 160. This arrangement facilitates selective raising and lowering of the back rest support beam 152.

The back rest 150 can be an extendable back rest 150. Support for the user's back is provided by an adjustable or slidable back rest panel 154. The back rest panel 154 can be a generally rectangular or square sheet of material with one end pivotally mounted by pivot 141 to the seat panel 140. To facilitate adjustment of the back rest panel 154, the back rest panel 154 includes a pair of elongate, spaced linear guide channels 155 formed on a back surface of the back rest panel 154. A corresponding pair of linear guide rails 153 extends from back rest support beam 152. The guide rails 153 can move vertically within the guide channels 155 to allow the back rest panel 154 to be raised and lowered vertically along the guide rails 153 during the folding and unfolding operations. Moreover, the guide rails 153 and the guide channels 155 enable vertical adjustment of the back rest panel 154 to conform to the desired comfort level of the user. Each guide channel 155 is preferably open-ended at the top and closed at the bottom to enable introduction of the corresponding guide rail 153 during assembly. The top portion of the back rest panel 154 includes an elongate handle slot 154*a* for the user to grab during unfolding or transport. It is noted that the number of guide channels 155 and the corresponding guide rails 153 may be varied. Moreover, the guide channels 155 and the guide rails 153 may be a dovetail-type connection for additional secure engagement.

Figure 6B:
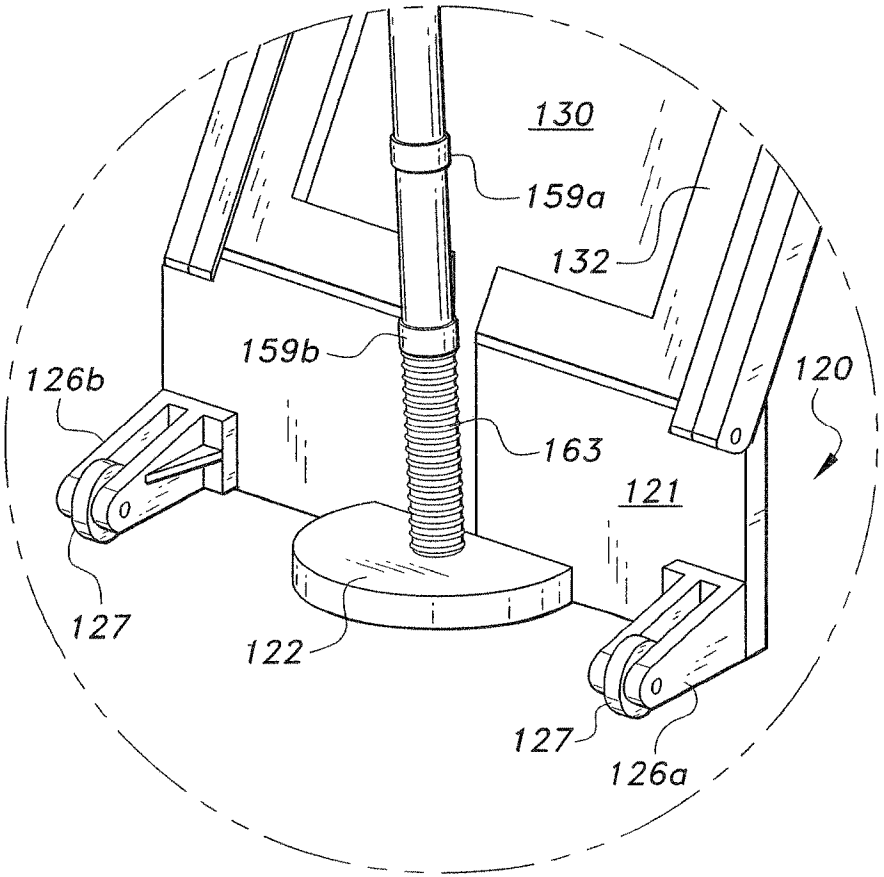
FIG. 6B is a detailed view of the lower portion of the foldable chair shown in FIG. 6A.
Figure 6A:
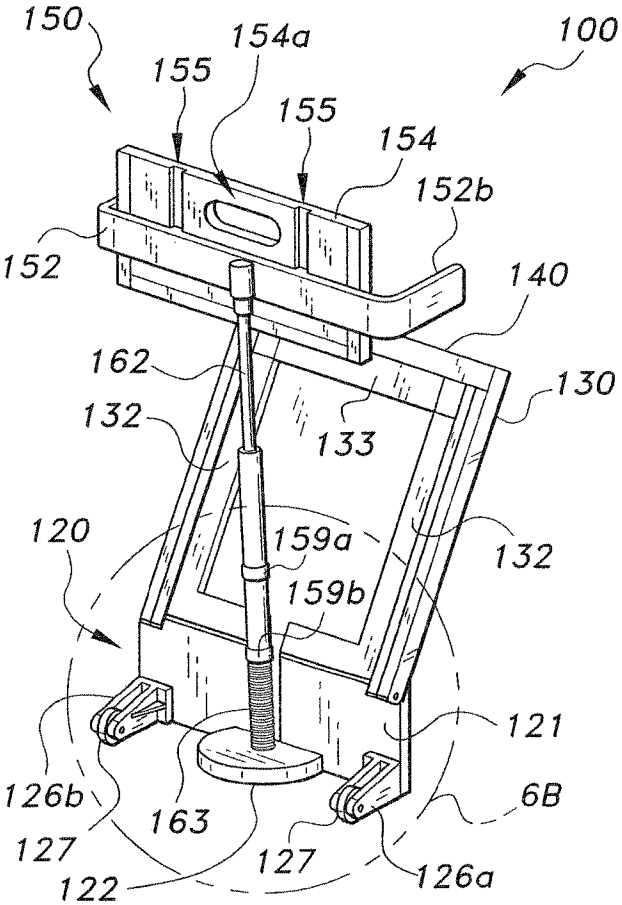
FIG. 6A is a rear perspective view of the foldable chair shown in FIG. 5 in a transitional unfolding state with the housing removed for clarity.

A spring mount post 164 extends behind the base beam 121 to receive the variable resistance support assembly 160. Additional features of the variable resistance support assembly 160 include one or more spring spacers 159*a* and 159*b* (FIGS. 6A and 6B). The spring spacers 159*a*, 159*b* can provide alignment and/or define the limits of spring movement. The spring spacer 159*b* can be connected to the second spring 163. The second spring 163 has a lighter pressure load than the first spring 162.

A seat support collar 165 is mounted to the housing 161. The seat support collar 165 includes an elongate, radially extending support ledge. The support ledge serves as an abutment stop to support the seat panel 140 when in the seating configuration. This arrangement enables the seat panel 140 to be supported at opposite ends by the corner abutment stops 134*a*, 134*b* and the seat support collar 165.

Figures 7A, 7B, 7C:
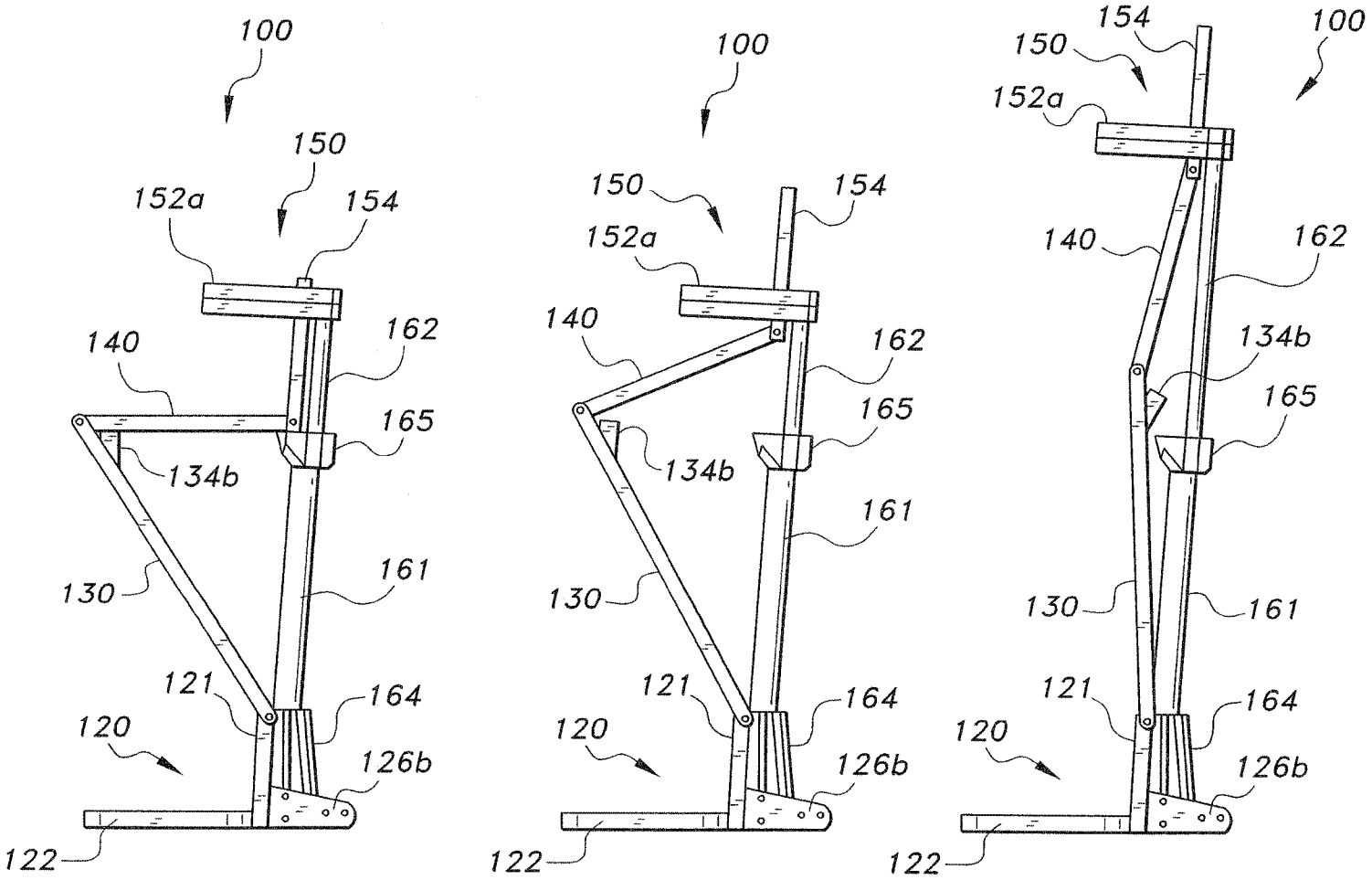
FIGS. 7A, 7B, and 7C are side views of the foldable chair shown in FIG. 5 progressing through a folded state (FIG. 7A), a transitional state (FIG. 7B), and an unfolded state (FIG. 7C).

The user can sit comfortably on the seat panel 140 when the seat panel is in the first or seating positon, as shown in FIG. 7A. When the user begins to stand from a seated position, the user's movement can cause the seat panel 140 to pivot counterclockwise (CW) about the third pivot 141 and CCW about the second pivot 131*b*, as seen in the side views of FIGS. 7A and 7B. Pivoting of the seat panel 40 forces the pivotable support 30 to pivot CCW about the first pivot 131*a* of the pivotable support 130. As the user is standing, the user's movement alone can raise the back rest 150 and the first spring 162 connected thereto, and the combined pivoting motions of the seat panel 140 and the pivotable support 130 folds the foldable chair 100 into the second or seating position shown in FIG. 7C. Thus, the first spring 162 may be configured to automatically raise the seat panel 40 when the pressure of the user's weight is removed from the seat panel 140 during the process of standing. Additionally or alternatively, the foldable chair 100 may be configured to fold when the armrests 52*a*, 52*b* are lifted. To extend the foldable chair 100 into the seat configuration or state, the user simply reverses the above process by applying pressure to the seat panel 140 by sitting thereon and/or by pushing down on the armrests 152*a*, 152.

Figure 8:
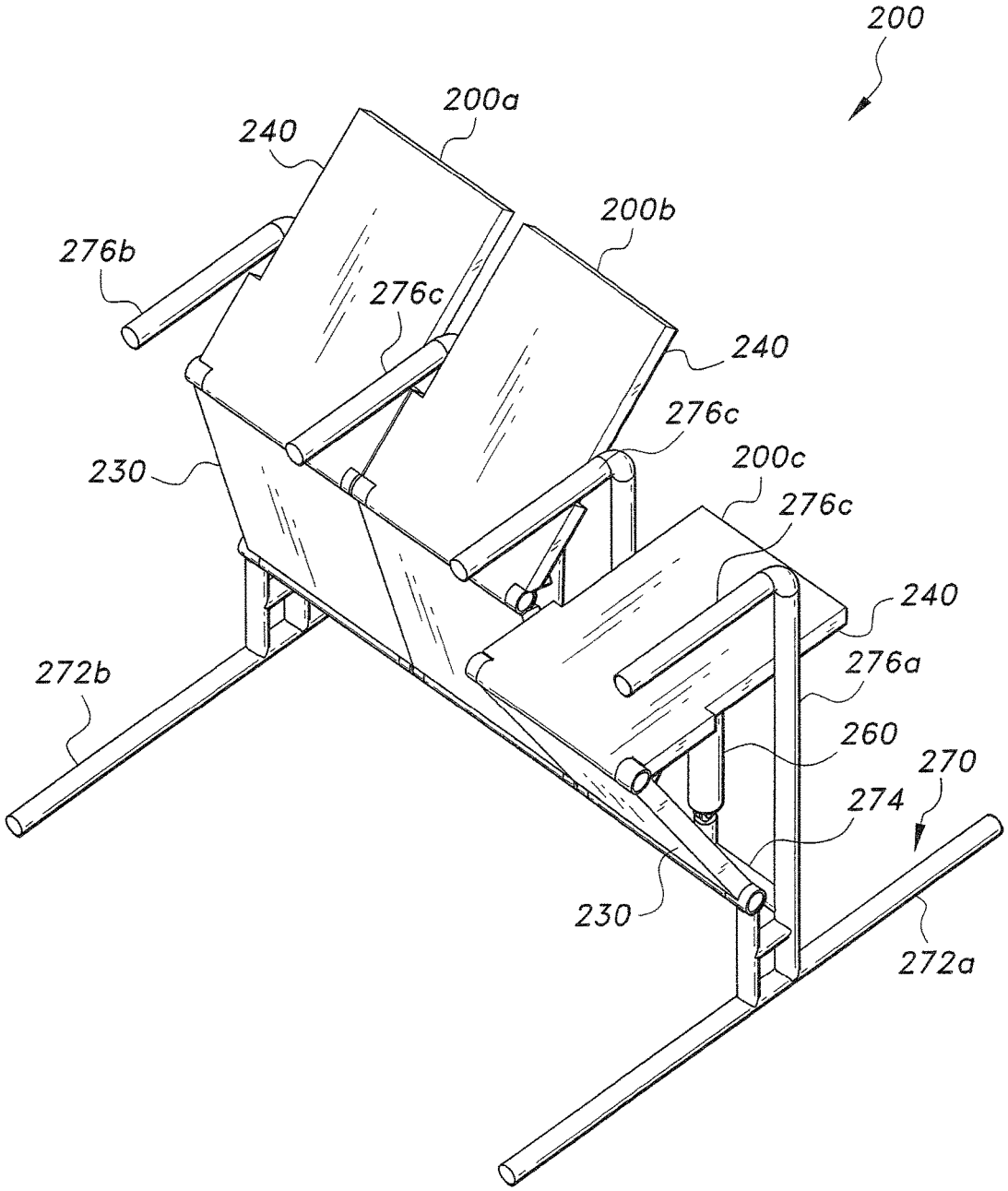
FIG. 8 is a perspective view of an embodiment of a foldable chair system according to the present invention.

FIG. 8 illustrates a foldable chair system 200 including a plurality of foldable chairs 200*a*-200*c*. Similar to the foldable chair 10, each foldable chair 200*a*-200*c* includes a seat panel 240 having a first end portion and an opposing second end portion, a pivotable support 230 pivotally connected to the first end portion of the seat panel 240, and a variable resistance assembly 260 coupled to the second end portion of the seat panel. The variable resistance assembly for each of the foldable chairs 200*a*-200*c* can generally be the same as the telescoping support assembly described for the foldable chair 10. The foldable chairs 200*a*-200*b*, however, do not include a back rest 50. Further, unlike, the foldable chair 10, each of the foldable chairs 200*a*-200*c* are not by themselves free-standing and are not portable. Instead, the foldable chairs are connected to a common stand 270 having two generally parallel base supports 272*a*, 272*b*, a pair of upright end armrests 276*a*, 276*b* extending normal to each base support 272*a*, 272*b*, a horizontal connecting support 274 extending between and connecting the end armrests 276*a*, 276*b*, and one or more central upright armrests 276*c* extending normal to the connecting support 274. The central armrests 276*c* extend between adjacent ones of the foldable chairs 200*a*-200*c*.

Figure 9:
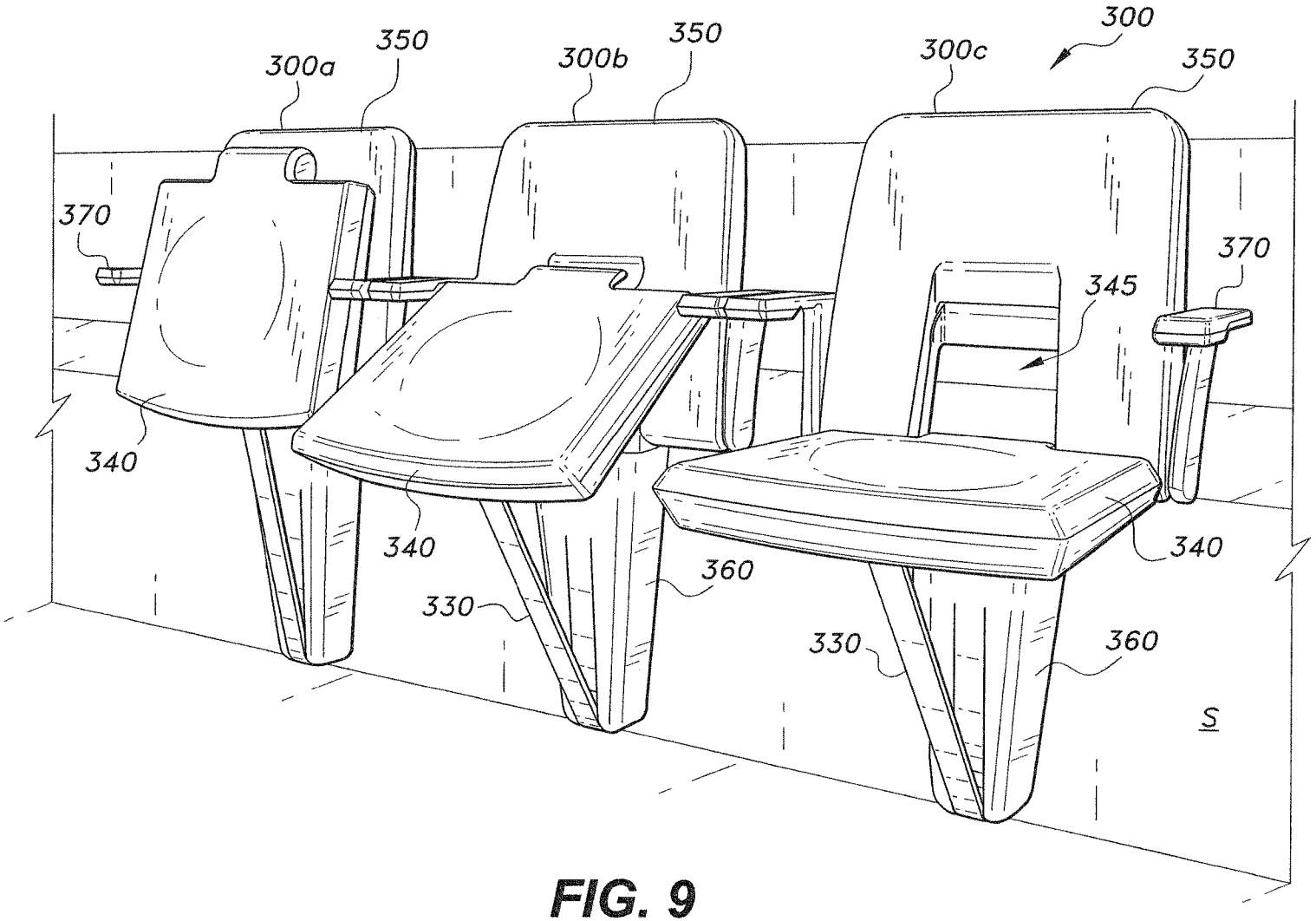
FIG. 9 is a perspective view of another embodiment of a foldable chair system according to the present invention.

FIG. 9 illustrates a foldable chair system 300 including a plurality of foldable chairs 300*a*-300*c*. Similar to the foldable chairs 10 and 100, each foldable chair 300*a*-300*c* includes a seat panel 340 having a first end portion and an opposing second end portion, a pivotable support 330 pivotally connected to the first end portion of the seat panel 340, a back rest 350, and a variable resistance assembly 360 coupled the second end portion of the seat panel 340. The variable resistance assembly 360 for each of the foldable chairs 300*a*-300*c* can generally be the same as the telescoping assembly described for the foldable chair 10. Unlike, the foldable chair 10, however, each of the foldable chairs 300*a*-300*c* are not by themselves free-standing and are not portable. Instead, the variable resistance assembly 360 of each foldable chair 300*a*-300*c* is affixed to a common stationary support S. The stationary support S can be a permanent fixture of the area in which the foldable chairs 300*a*-300*c* are positioned, e.g., theater, auditorium, etc.

It is to be understood that the present invention is not limited to the embodiments described above, but encompasses any and all embodiments within the scope of the following claims.

I claim:

1. A foldable chair, comprising:

a seat panel having a first end portion and an opposing second end portion;

a pivotable support having a first end portion and an opposing second end portion, the first end portion of the pivotable support pivotally coupled to the first end portion of the seat panel;

a variable resistance support assembly pivotally coupled to the second end portion of the seat panel, the variable resistance support assembly being compressible to selectively lower the second end portion of the seat panel in response to a force exerted by the user on the seat panel and configured to provide at least two levels of resistance as the second end portion of the seat panel is lowered;

a base having a front, back, and opposing sides, the base being coupled to the variable resistance support assembly;

a foot rest extending in a first direction from the base, wherein the foot rest comprises an L-shaped bracket detachably mounted to the base, the L-shaped bracket having a first section attached to the base and a second section having a central rib dividing the foot rest into left and right web sections for receiving the user's feet; and at least one brace leg extending from the base in a second direction opposite the first direction, wherein the second end portion of the pivotable support is pivotally coupled to the base.

2. The foldable chair according to claim 1, wherein said foot rest comprises an elongate plate detachably mounted to said base, the plate having a major section extending towards the front of said foldable chair and a minor section extending towards the back of said foldable chair.

3. The foldable chair according to claim 1, wherein said at least one brace leg comprises a pair of spaced brace legs, said brace legs extending from opposing sides of said base.

4. The foldable chair according to claim 1, wherein said at least one brace leg comprises a pair of spaced brace legs, each brace leg having a caster at a distal end thereof.

5. The foldable chair according to claim 1, wherein the variable resistance support assembly comprises a telescoping support assembly including a first spring and a second spring, the first spring connected to the seat panel at one end and to the second spring at an opposing end, the second spring having less resistance than the first spring.

6. The foldable chair according to claim 5, wherein the variable resistance assembly further comprises a seat panel support connecting the first spring to the seat panel, the seat panel support being pivotally connected to the second end portion of the seat panel.

7. The foldable chair according to claim 6, further comprising a back rest, the back rest being affixed to the seat panel support.

8. The foldable chair according to claim 7, wherein the back rest further comprises a pair of spaced armrests extending horizontally from the back rest.

9. The foldable chair according to claim 5, wherein the first spring is a gas spring.

10. The foldable chair according to claim 5, wherein the second spring is a compression spring.

11. The foldable chair according to claim 1, further comprising an extendable back rest having one end pivotally coupled to the second end portion of the seat panel, the back rest having a pair of spaced armrests, wherein the back rest comprises a slidable back rest panel and a back rest support beam slidably mounted to the back rest panel.

12. A method of supporting a user above a floor surface, comprising providing a chair including:

a seat panel having a first end portion and an opposing second end portion, a pivotable support having a first end portion and an opposing second end portion, the first end portion of the pivotable support pivotally coupled to the first end portion of the seat panel, a variable resistance support assembly pivotally coupled to the second end portion of the seat panel, the variable resistance support assembly being compressible to selectively lower the second end portion of the seat panel in response to a force exerted by the user on the seat panel and configured to provide at least two levels of resistance as the second end portion of the seat panel is lowered;

a base having a front, back, and opposing sides, the base being coupled to the variable resistance support assembly;

a foot rest extending in a first direction from the base, wherein the foot rest comprises an L-shaped bracket detachably mounted to the base, the L-shaped bracket having a first section attached to the base and a second section having a central rib dividing the foot rest into left and right web sections for receiving the user's feet; and at least one brace leg extending from the base in a second direction opposite the first direction, wherein the second end portion of the pivotable support is pivotally coupled to the base;

lowering the second end portion of the seat panel from at least one elevated position to a lowered position in response to a motion of the user sitting on the seat panel;

compressing the variable resistance support assembly to a first degree in response to a first amount of force exerted on the seat panel by the user during the sitting motion; and compressing the variable resistance support assembly to a second degree in response to a second amount of force exerted on the seat panel by the user during the sitting motion, the first amount of force being less than the second amount of force.

13. The method of supporting a user above a floor surface according to claim 12, further comprising:

extending the variable resistance support assembly and raising the second end portion of the seat panel to the at least one elevated position in response to a motion of a user rising from a seated position on the seat panel, whereby extension of the variable resistance support assembly facilitates lifting of the user to a standing positon.

14. A foldable chair, comprising:

a seat panel having a first end portion and an opposing second end portion;

a pivotable support having a first end portion and an opposing second end portion, the first end portion of the pivotable support pivotally coupled to the first end portion of the seat panel;

a variable resistance support assembly pivotally coupled to the second end portion of the seat panel, the variable resistance support assembly being compressible to selectively lower the second end portion of the seat panel in response to a force exerted by the user on the seat panel and configured to provide at least two levels of resistance as the second end portion of the seat panel is lowered;

a base having a front, back, and opposing sides, the base being coupled to the variable resistance support assembly;

a foot rest extending in a first direction from the base, wherein the foot rest comprises an elongate plate detachably mounted to the base, the plate having a major section extending towards the front of the foldable chair and a minor section extending towards the back of the foldable chair; and at least one brace leg extending from the base in a second direction opposite the first direction, wherein the second end portion of the pivotable support is pivotally coupled to the base.

* * * * *